US007869722B2

(12) United States Patent
Milton et al.

(10) Patent No.: US 7,869,722 B2
(45) Date of Patent: Jan. 11, 2011

(54) BLADE MAINTENANCE PROCESS AND SYSTEM FOR MAINTAINING ADEQUATE TONER DAM

(75) Inventors: Derek John Milton, Welwyn Garden (GB); Stuart John Handley, Welwyn Garden (GB); Tim Spink, Welwyn (GB); Julian Derek Morrison, Hertfordshire (GB); Pieter Mulder, Duizel (NL)

(73) Assignee: Xerox Corporation, Norwalk, CT (US)

( * ) Notice: Subject to any disclaimer, the term of this patent is extended or adjusted under 35 U.S.C. 154(b) by 597 days.

(21) Appl. No.: 11/944,031

(22) Filed: Nov. 21, 2007

(65) Prior Publication Data

US 2009/0129793 A1 May 21, 2009

(51) Int. Cl.
*G03G 21/00* (2006.01)
*G03G 15/00* (2006.01)

(52) U.S. Cl. ..... 399/34; 399/71

(58) Field of Classification Search ..... 399/350, 399/346, 343, 347, 38, 34, 71
See application file for complete search history.

(56) References Cited

U.S. PATENT DOCUMENTS 5,349,429 A 9/1994 Jugle et al.
5,463,455 A * 10/1995 Pozniakas et al. ..... 399/350
6,438,329 B1 8/2002 Budnik et al.
7,043,188 B2 5/2006 Curynski et al.
2007/0116483 A1* 5/2007 Kobayashi et al. ..... 399/49

FOREIGN PATENT DOCUMENTS

JP 2006317644 A * 11/2006

OTHER PUBLICATIONS

Machine English translation of JP 2006317644.*

* cited by examiner

*Primary Examiner*—David M Gray
*Assistant Examiner*—Billy J Lactaoen
(74) *Attorney, Agent, or Firm*—Oliff & Berridge, PLC

(57) ABSTRACT

A toner dam maintenance process and system model the amount of toner mass at a toner cleaner blade, and apply a corrective procedure, such as insertion of a paperless copy into the print job mid-job or immediately prior to cycle out, to replenish the toner mass at the cleaner blade to maintain lubrication and reduce cleaning failure. The modeling includes contributing factors toward toner dam input and output, including untransferred toner, cycle-in/cycle-out bands, untransferred background, and leakage of toner from the cleaner blade. One or several threshold can be reached to cause one or more different corrective actions to take place. The action may be adding or skipping a pitch to insert a corrective maintenance pattern without transfer.

17 Claims, 5 Drawing Sheets

BLADE MAINTENANCE PROCESS AND SYSTEM FOR MAINTAINING ADEQUATE TONER DAM

BACKGROUND

The disclosure relates generally to the cleaning of a photoconductive member of an electrophotographic machine. More particularly, the disclosure relates to a cleaning blade maintenance process and system that calculates the amount of toner mass at a toner cleaner blade, and applies a corrective procedure, such as insertion of a paperless copy into the print job, to replenish the toner mass at the cleaner blade, reducing cleaning failure by maintaining a toner level to give adequate lubrication and also by inhibiting migration of debris, such as paper fibres, to the blade tip.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. Toner particles attracted from the carrier granules to the latent image form a toner powder image on the photoconductive member. The toner powder image is then transferred from the photoconductive member to a copy sheet. Heating of the toner particles permanently affixes the powder image to the copy sheet. After each transfer process, the toner remaining on the photoconductor is cleaned by a cleaning device.

One type of cleaning device is a urethane blade that is configured in either a wiper or doctor mode to remove residual toner and other particles. In some instances a disturber brush is used in combination with the blade to remove paper debris and to disturb the residual toner image. It is known that the residual toner acts as a lubricant for the cleaner blade and helps to minimize blade tuck, which can lead to streaking of the image or can cause blade and/or photoreceptor damage. One way of replacing lost blade lubrication is to place a toner swath across a photoreceptor at some known interval to assure blade lubrication.

U.S. Pat. No. 6,438,329 to Budnik et al., commonly assigned to Xerox Corporation and incorporated herein by reference in its entirety, provides a customer replaceable unit (CRU) having a cleaning blade lubrication system. Upon initial usage of the CRU, a toner patch is developed without being transferred to deposit an initial layer of toner on the cleaning blade for lubrication. No replenishment is provided.

U.S. Pat. No. 5,463,455 to Pozniakas et al., commonly assigned to Xerox Corporation and incorporated herein by reference in its entirety, provides an adaptive cleaning blade lubrication system for electrophotographic printing machines that calculates the density of each transferred image and deposits a band of toner in an interdocument gap that lubricates the cleaner blade across its width.

U.S. Pat. No. 5,349,429 to Jugle et al., commonly assigned to Xerox Corporation and herein incorporated by reference in its entirety, provides a cleaner blade lubrication system that continuously provides lubrication to the cleaning blade through use of a downstream foam lubricating roll that uses waste toner cleaned from the imaging surface to continuously lubricate the cleaning blade.

SUMMARY

During electrophotographic printing machine usage, a toner dam may develop on a leading edge of the cleaner blade between the cleaner blade and photoreceptor. In certain known copier devices, a series of cleaning failures have been observed that resulted in unscheduled maintenance calls and module failures. The typical symptoms of the failures involved streaks on the resultant hard copy prints, which reduced the performance of such copiers. Investigations revealed that fibers, such as from copy paper, were found present on the cleaner blade, squeezed between the blade and photoreceptor. This can occur when the toner dam has been depleted over time. Thus, this dam level fluctuates over time depending on several factors. Keeping a good dam is a prerequisite for effective cleaning. However, current machines either do not address lubrication or provide lubrication using limited toner information and with corrective procedures that could be improved.

It is desirable to be able to ensure proper cleaning blade operation by replenishing the toner dam mass based on a model of toner dam level that more accurately reflects the level of toner dam over time.

It is also desirable to provide a blade maintenance system and method that remain unobtrusive to a machine user as much as possible so as not to interfere with or delay completion of a customer's print job, while avoiding cleaner blade damage and problems.

In accordance with aspects of the disclosure an adaptive cleaner blade lubrication system for an electrophotographic machine includes a cleaner blade, a photoconductive surface and a controller. The photoconductive surface receives toner images thereon that passes across the cleaner blade, the cleaner blade cleaning toner from the surface thereof while leaving a toner dam on an upstream side of the cleaner blade. The photoconductive surface has at least one imaging region of a predetermined size used to image print jobs. The controller includes a toner level estimating section that models a toner dam balance of the cleaner blade over time based on received toner input sources including untransferred toner from the print jobs, cycle-in/cycle-out bands of the electrophotographic machine, and untransferred background minus estimated toner leakage from the cleaner blade. The controller also includes a toner level correction section that provides at least one corrective action to the electrophotographic machine to replenish the toner dam towards a target level range when the toner dam balance is below a threshold level.

In accordance with additional aspects of the disclosure, a cleaner blade lubrication method for an electrophotographic machine includes: operating the electrophotographic machine having a photoconductive surface on which toner is applied and passed across a cleaner blade forming a toner darn upstream of the cleaner blade; modeling a toner dam balance of the cleaner blade over time based on received toner input sources including untransferred toner from print jobs, cycle-in/cycle-out bands of the electrophotographic machine, and untransferred background minus estimated toner leakage from the cleaner blade; and performing at least one corrective action to the electrophotographic machine to replenish the toner dam towards a target level range when the toner dam balance is below at least one threshold level.

In certain embodiments, multiple corrective levels are provided, each providing a different degree of corrective action.

In exemplary embodiments, toner darn balance is predicted based on a model that reflects an input of toner to the toner dam from sources including untransferred toner, cycle-in/cycle-out bands, and untransferred background minus toner leakage from the cleaner blade during advancement of photoconductive surface 12 past the cleaning blade.

BRIEF DESCRIPTION OF THE DRAWINGS

Exemplary embodiments will be described with reference to the accompanying drawings, wherein like numerals represent like parts, and in which.

EMBODIMENTS

Figure 1:
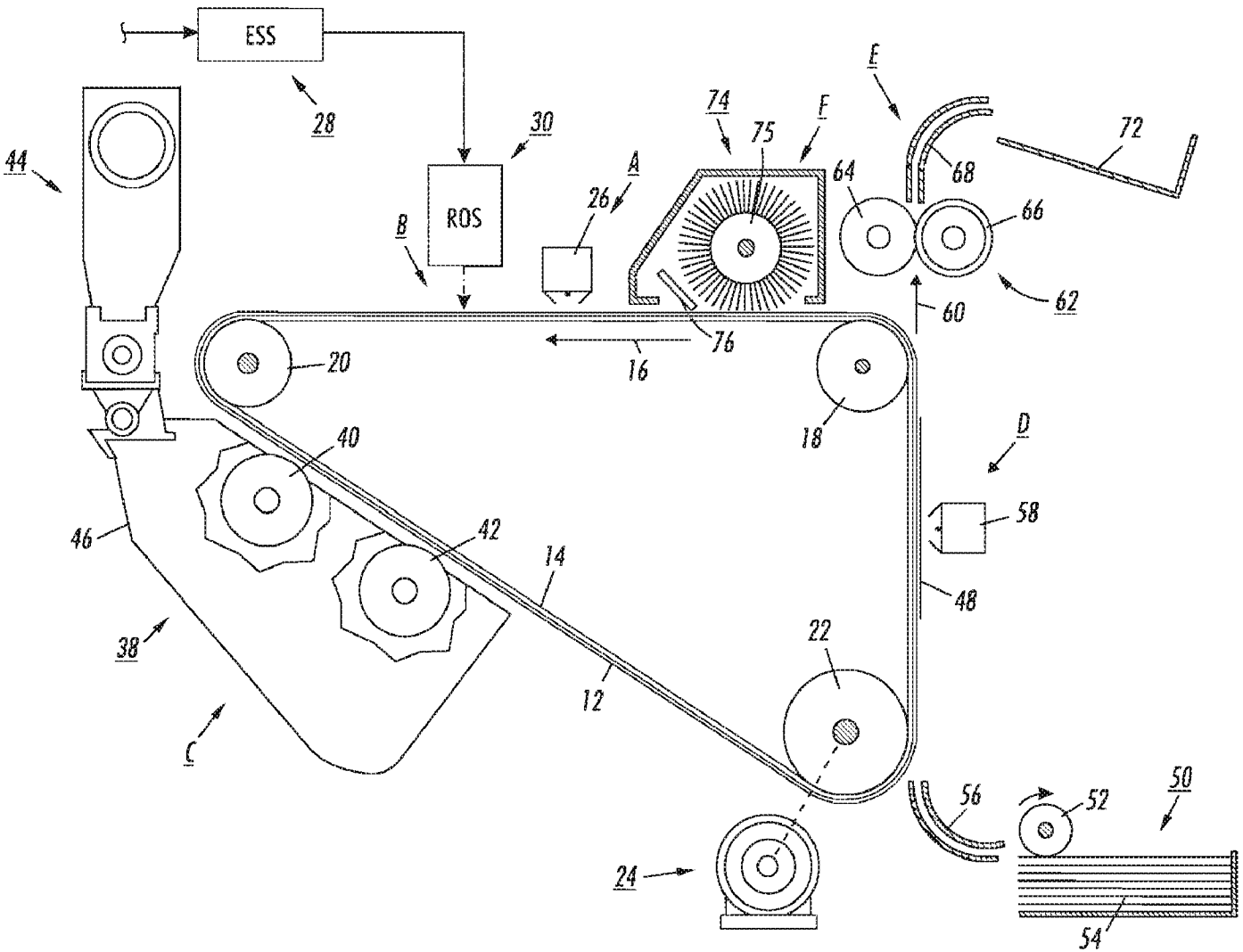
FIG. 1 is a schematic elevational view of an electrophotographic printing machine including a cleaning blade lubrication system.

FIG. 1 schematically illustrates an electrophotographic printing machine, such as a digital copier, which generally employs a photoreceptor 10, such as a drum or belt, having a photoconductive surface 12 deposited on a conductive ground layer 14. Preferably, photoconductive surface 12 is made from a photoresponsive material, for example, one comprising a charge generation layer and a transport layer. Photoreceptor 10 moves in the direction of arrow 16 to advance successive portions of the photoreceptor sequentially through the various processing stations disposed about the path of movement thereof.

Photoreceptor 10, shown in the form of a belt, may be entrained about stripping roller 18, tensioning roller 20 and drive roller 22. Drive roller 22 is driven by motor 24 to advance photoreceptor 10 in the direction of arrow 16. Photoreceptor 10 may be maintained in tension by a pair of springs (not shown) resiliently urging tensioning roller 20 against photoreceptor 10 with a desired spring force. Stripping roller 18 and tensioning roller 20 may be mounted to rotate freely.

Initially, a portion of photoreceptor 10 passes through charging station A. At charging station A, a corona generating device, indicated generally by the reference numeral 26 charges the photoconductive surface 12 to a relatively high, substantially uniform potential. After photoconductive surface 12 of photoreceptor 10 is charged, the charged portion thereof is advanced through exposure station B.

At an exposure station, B, a controller or electronic subsystem (ESS), indicated generally by reference numeral 28, receives the image signals representing the desired output image and processes these signals to convert them to a continuous tone or grayscale rendition of the image, which is transmitted to a modulated output generator, for example the raster output scanner (ROS), indicated generally by reference numeral 30. The image signals transmitted to ESS 28 may originate from a computer, thereby enabling the electrophotographic printing machine to serve as a remotely located printer for one or more computers. Alternatively, the printer may serve as a dedicated printer for a high-speed computer.

The signals from ESS 28, corresponding to an image desired to be reproduced by the printing machine, are transmitted to ROS 30. ROS 30 includes a laser with rotating polygon mirror blocks. The ROS illuminates the charged portion of photoconductive belt 10 at a suitable resolution. The ROS exposes the photoconductive belt to record an electrostatic latent image thereon corresponding to the image received from ESS 28. As an alternative, ROS 30 may employ a linear array of light emitting diodes (LEDs) arranged to illuminate the charged portion of photoconductive belt 10 on a raster-by-raster basis.

ESS 28 may be connected to a raster input scanner (RIS). The RIS may have document illumination lamps, optics, a scanning drive, and photosensing elements, such as an array of charge coupled devices (CCD) to capture an entire image from an original document and convert it to a series of raster scanlines that are transmitted as electrical signals to ESS 28. ESS 28 processes the signals received from the RIS and converts them to grayscale image intensity signals which are then transmitted to ROS 30. ROS 30 exposes the charged portion of the photoconductive belt to record an electrostatic latent image thereon corresponding to the grayscale image signals received from ESS 28.

After the electrostatic latent image has been recorded on photoconductive surface 12, photoreceptor 10 advances the latent image to a development station, C, where toner is electrostatically attracted to the latent image. As shown, at development station C, a magnetic brush development system, indicated by reference numeral 38, advances developer material into contact with the latent image. Magnetic brush development system 38 includes at least one magnetic brush developer, such as rollers 40 and 42 shown. Rollers 40 and 42 advance developer material into contact with the latent image. These developer rollers form a brush of carrier granules and toner particles extending outwardly therefrom. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Sheet feeding apparatus 50 may include a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image formed thereon contacts the advancing sheet at transfer station D. Transfer station D may include a corona generating device 58 that sprays ions onto the back side of sheet 48. This attracts the toner powder image from photoconductive surface 12 to sheet 48. After transfer, sheet 48 continues to move in the direction of arrow 60 onto a conveyor (not shown), which advances sheet 48 to fusing station E.

Fusing station E includes a fuser assembly, indicated generally by the reference numeral 62, which permanently affixes the transferred powder image to sheet 48. Fuser assembly 62 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 68 to catch tray 72 for subsequent removal from the printing machine by the operator.

After the print sheet is separated from photoconductive surface 12 of belt 10, the residual toner/developer and any paper fiber particles adhering to photoconductive surface 12 are cleaned at cleaning station F. Cleaning station F will include a housing 74 and may contain a rotatably mounted fibrous brush 75 in contact with photoconductive surface 12 to disturb and remove paper fibers and cleaning blade 76 to remove the non-transferred toner particles. The cleaning blade 76 may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

Figure 2:
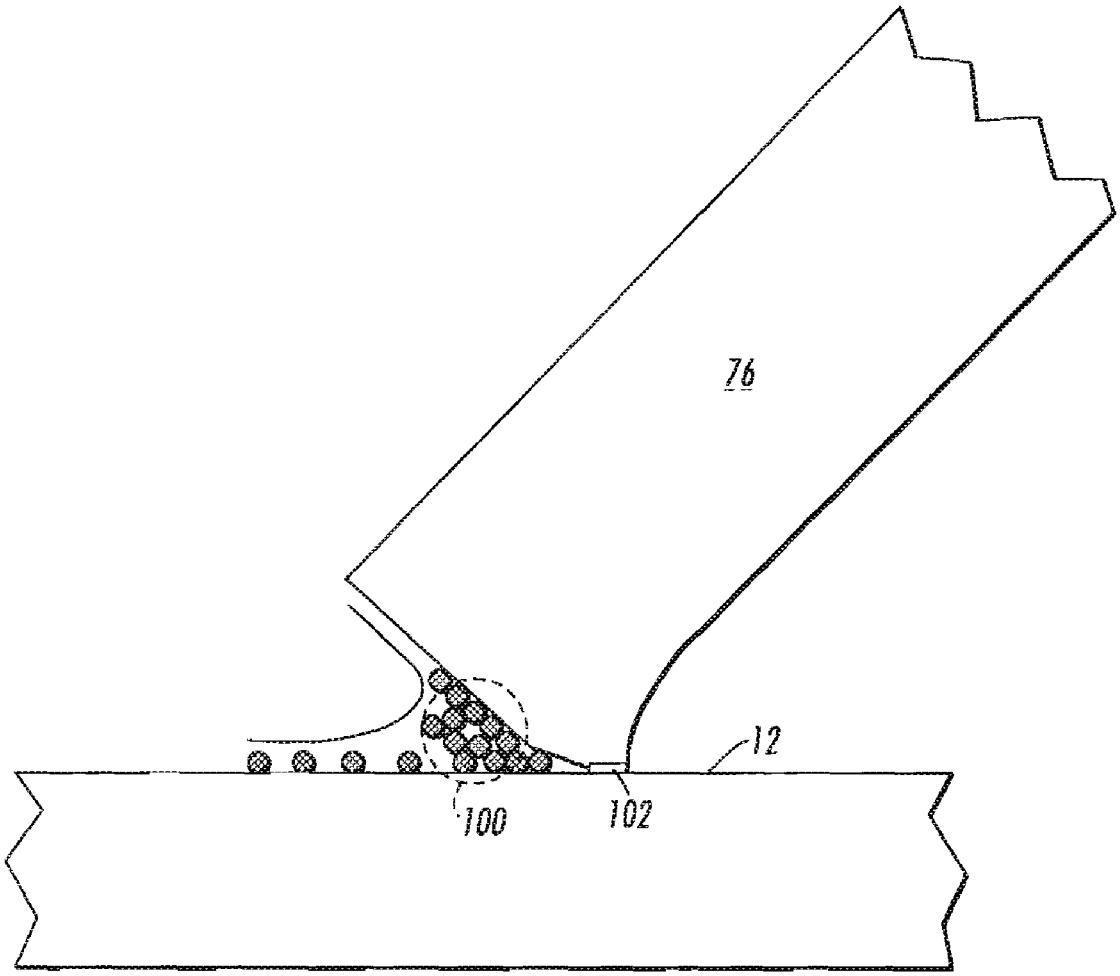
FIG. 2 is a close-up of an exemplary clearing blade of the cleaning blade lubrication system of FIG. 1 showing a toner dam region that collects toner particles from the photoreceptor and serves as a source of blade lubrication.

FIG. 2 shows a close-up of an exemplary cleaning blade 76 showing a toner dam region 100 that collects toner particles from the photoconductive surface 12 and serves as a source of blade lubrication. In particular during operation, blade 76 contacts moving photoconductive surface 12 at a nip area 112 to clean the surface of remaining toner particles. During this cleaning, the leading edge between the surface 12 and cleaner blade, 76 acquires a buildup of toner particles forming the toner dam region 100. Maintaining a good toner darn has been found beneficial to cleaning and blade life. In this regard, analysis of the various cleaning failure problems and mass-balance of toner at the toner dam 100 revealed that there is a strong correlation between the rate of problems and the size of the dam. The toner dam operated best when it was not too small or too large. If the toner dam is too small, blade life and paper fiber problems may occur. If the toner dam is too large, there is no beneficial effect and it will unnecessarily waste toner. Thus, there has been found to be an optimal target range of toner dam mass. This level may typically be from about 0.1 mg to 1.0 mg per cm of blade length but will vary by machine.

An embodiment maintains the cleaning blade with a proper toner dam balance that restores the dam towards or within a target range and, therefore, prevents paper fibers from getting under the blade, or micro tuck from a lack of lubrication, causing subsequent failures. This mechanism models the toner mass balance (TMB) at the dam, and replenishes the toner through a paperless copy of an image under various conditions depending on the estimated toner darn level.

In an exemplary embodiment, a paperless copy is achieved by forming a suitable low or high area coverage maintenance image on the photoconductive surface 12 during a skipped pitch interrupted in the middle of a current print job, or a pitch provided at the end of a print job when the machine would otherwise be idle. This toner image on an imaging region of the photoconductive surface 12 is then advanced to the cleaning station F without transfer to paper so that all of the toner for the image on the photoconductor surface 12 is provided to cleaner blade 76 for toner dam replenishment. In certain embodiments, the toner image may be a generally uniform density image of any suitable image color that covers a substantial portion of the page, at least in the height direction or cross-process direction of the photoconductive surface 12 so that the entire length of the cleaner blade 76 may be replenished.

Toner can reach the dam 100 in three ways: (1) untransferred toner; (2) cycle-in/cycle-out bands; and (3) untransferred background. Thus, exemplary embodiments model the toner mass over time based on an estimate of the input of toner mass, minus the output of toner mass at the blade edge during advancement of the surface 12 past the cleaning blade 76. As mentioned above, toner mass input can come from three sources, which can be suitably modeled either experimentally or empirically. For example, a test image of a defined pixel count may be imaged, transferred, and then the residual amount of untransferred toner remaining on the photoconductive surface 12 can be collected and weighed to develop an approximate calibration constant for a given pixel count. Similarly, cycle-in and cycle-out procedures could be tested and appropriate calibration constants developed to assess the contribution of toner mass input attributable to these events. Likewise, untransferred background, attributable to wrong polarity toner developed into background areas can be tested and suitable calibration constants developed. The untransferred background is nominally characterized in terms of number of toner particles per square mm and this is converted into a mass for use in the control algorithm.

Regarding toner mass output, toner can be assumed to leak away from the dam at a constant, determinable rate during the cleaning process. This occurs, for example, by leaking of toner through nip 102 and movement of the photoconductive surface 12 past blade 76, such that the toner is transported back to the developer roll 40 (FIG. 1). Thus, output can be considered a constant rate from which a total loss amount can be determined from the time period between cycle-in and cycle-out.

Toner dam mass balance may thus be modeled from these contributing inputs and outputs to assess and approximate the toner mass balance at the blade 76 edge over time. If the prediction reaches one or more threshold low levels, one or more corrective procedures can be implemented.

Figure 3:
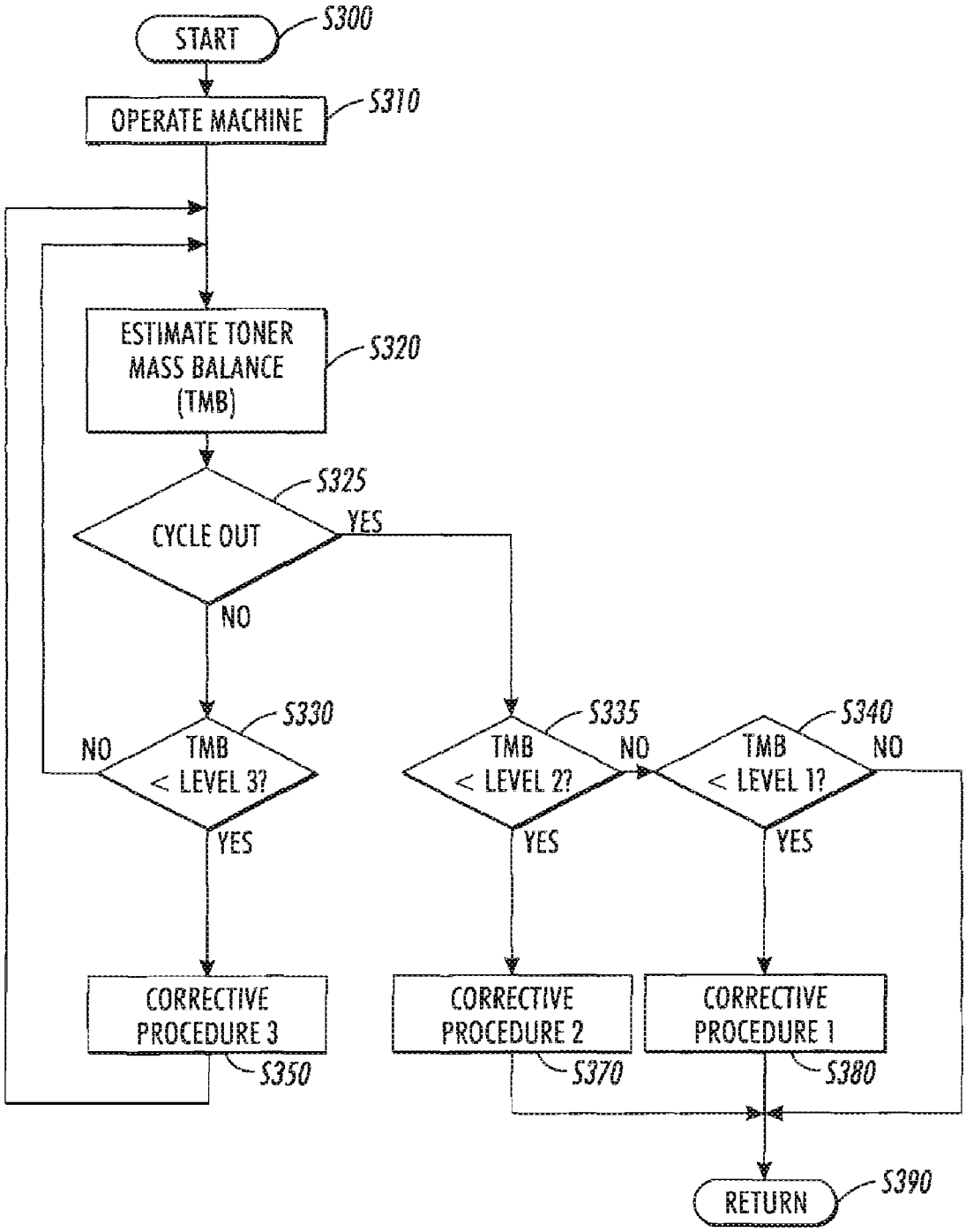
FIG. 3 is a flowchart of an exemplary blade maintenance method for replenishment of the toner dam.

In the exemplary flowchart of FIG. 3, a blade maintenance method is shown that can initiate various corrective procedures at a plurality of corrective threshold levels. An aspect of the method is to quickly replenish the toner dam to a desired level, preferably in as unobtrusive a way as possible to the user of the electrophotographic machine. The process starts at step S300 and advances to step S310 where an electrophotographic machine such as the one shown in FIG. 1 starts operating by scheduling and printing one or more print jobs. Flow then advances to step S320 where an estimate of the toner mass balance (TMB) at the toner is performed based on a series of criteria taking into account, for example, toner inputs such as image content (such as pixel counts), cycle-in and cycle-out bands, untransferred background, leakage from the cleaner blade, and the like.

It is desirable to keep maintain a toner level that is not too low or too high. This level may typically be from about 0.1 mg to 1.0 mg per cm of blade length but will vary by machine and can be set to include a minimum toner dam level sufficiently above a level that may cause damage to ensure safe operation of the blade cleaner, prevent damage to the blade itself or photoconductive surface, and to inhibit paper fibers from passing through the blade cleaner.

At step S325, it is determined whether the machine is at cycle out. If it is, flow advances to Step S335. Otherwise, flow advances to step S330 where it is determined whether any immediate corrective action is necessary. In particular, step S330 determines whether the toner dam balance is below a Level 3 threshold, which in this example is the highest threshold requiring the most corrective procedure to restore proper toner dam operation. If level 3 is exceeded at step S330, a corrective procedure 3 is performed at step S350 in an attempt to restore the TMB within or at least towards the target range at an earliest possible timing. Otherwise, if the toner dam is above the Level 3 threshold, flow returns to step S310 where the operation of the machine can be continued without corrective action being necessary.

An example of a corrective procedure 3 is described below with reference to FIG. 4, where restoring the TMB may be through an interruption of machine operation for a current print job (either immediately or when conveniently possible in advance of a cycle out condition, such as within several sheets of print) and insertion of a high area coverage maintenance image at a next regular print area frame of the photoconductor 12 to include a high area coverage sample image of toner. Thus, a pitch of a current job is skipped to allow for the corrective action. This maintenance image is then transported on the photoconductive member 12 past cleaner blade 76 without image transfer by station D so that a large mass of residual toner remains on member 12 for replenishing the toner dam. Upon correction, flow returns to step S310.

If, however, at step S325 cycle out is determined, flow advances to step S335 where it is determined whether the TMB is greater than a Level 2 threshold, which is a less demanding threshold than a Level 3 threshold. If Level 2 is exceeded, flow advances to step S370 where a different, second corrective procedure is performed. For example, a high area coverage maintenance image may be inserted at the end of current customer print job(s) in a print queue (after cycle out) for advancing past cleaner blade 76 without transfer. The process then flows to step S390 where the process returns to step S310.

If the TMB level is below Level 2 at step S335, flow advances to step S340 where it is determined whether the TMB is lower than a Level 1 threshold, which is a less demanding threshold than a Level 2 threshold. If so, flow advances to step S380 where a first corrective procedure is performed, which has a reduced corrective effect because the degree of deviation from the target range is less. For example, a low area coverage maintenance image may be inserted at the end of current customer print job(s) in a print queue (immediately prior to cycle out). From step 380, flow advances to step S390. Thus, in this illustrative example, there are three possible corrective actions. Two of the three corrective actions only occur at cycle out and provide moderate corrective procedures to restore relatively minor deviations from a desired target toner dam level. However, one of the corrective actions can more immediately provide corrective action for more dramatic toner dam level deficiencies. This provides a more intrusive corrective action when necessary, but otherwise unobtrusive corrective actions to occur immediately prior to cycle out.

Figure 4:
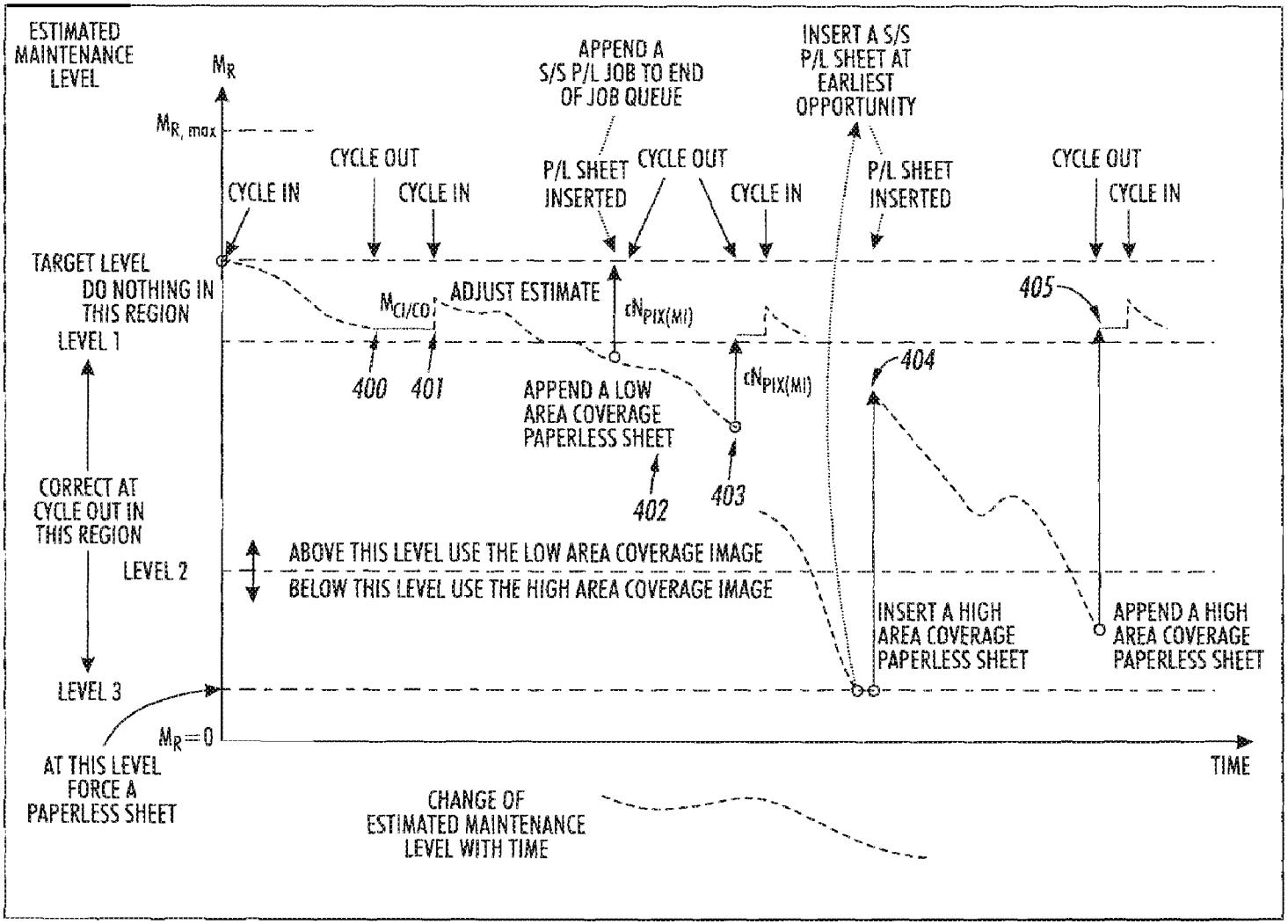
FIG. 4 is a functional chart showing an exemplary blade maintenance strategy for replenishment of the toner dam.

FIG. 4 provides an exemplary functional graph showing various scenarios of machine usage, along with exemplary corrective procedures enacted at a plurality of corrective threshold levels. The X-axis of the graph is time and the Y-axis represents the estimated toner dam mass balance (level). The region near the top of the graph between a target level and level 1 (labeled "Do Nothing in This Region") is the desired target mass range in which the toner dam mass is deemed sufficient for proper lubrication and operation of the cleaning station F.

It is assumed that at time to a desired toner dam level is achieved. During non-use, no change in level occurs. Time to may be some particular start point, such as replacement of a photoconductive surface or cleaner blade assembly, upon completion of a maintenance operation, or other time when the level can be computed, estimated or approximated. Upon start of a new customer job or warm-up of the machine, the machine may perform a cycle-in procedure. During this procedure, toner is received at the cleaner blade so the toner level is updated. Accordingly, during operation of the machine, one or a series of print jobs may be queued for printing. Depending on the length and type of job to be completed, the toner dam may be reduced by a varying amount. For example, if the job is a long job with a very low surface area coverage (low pixel count), the toner dam may deplete by a large amount. However, for a short job at high area coverage, the toner dam may deplete by only a small amount, or may even substantially maintain toner balance. This is because the amount of untransferred toner received at the cleaning station after transfer is directly proportional to the area coverage of the image and the amount of untransferred toner affects the input of toner mass to the cleaning blade 76.

To adequately compensate or restore the toner dam towards its target mass range, at least one, and preferably two or more maintenance levels may be provided. Each may have a different corrective procedure and may occur at differing times, such as immediately prior to cycle out and at mid-job.

In the illustrated example of FIG. 4, a first low level may be corrected by inserting a paperless low area coverage maintenance pattern at the end of a customer job. A second lower level may be corrected by inserting a paperless high area coverage pattern at the end of a customer job. By performing Level 1 and 2 corrective procedures after customer job(s), the corrective procedures are unobtrusive to the customer. That is, they occur during a period of non-use of the machine by the customer (at cycle out). However, if the toner dam mass drops to yet a third, lower level, a more intrusive corrective procedure may be used, such as a forced paperless sheet image inserted as an interrupt procedure mid-job, such as between jobs in the print queue or during the middle of a long current customer job, to achieve more immediate corrective action and prevent cleaner blade-related failures.

A more detailed explanation of an exemplary blade maintenance system and method will be described with continued reference to FIG. 4. At cycle-in of a print job, a small amount of toner is provided to the toner dam. This occurs as a consequence of the time taken to energize the electroxerographic devices in sequence and the need to avoid large cleaning fields at development, which could give development of carrier beads, resulting in damage to the photoreceptor and contamination of the machine. In this example, at initial startup, toner mass is at a desired target level as shown by the initial cycle-in at the left side of the graph. However, during production of the customer print job, the toner dam mass can be reduced over time, depending on the amount of untransferred toner and background toner received by the cleaner blade 76, and the time passed.

At the end of the first print job (cycle-out) indicated by reference numeral 400, toner dam mass is still shown to be within an acceptable target range reflected by the area between the target level and Level 1. At the start of a second job (cycle-in) indicated by reference numeral 401, the cycle-in process induces an increase in toner mass, which can be computed and taken into account by the blade maintenance software and is shown by the jump in toner mass level. During the second print job, it can be seen that the toner dam level estimate has dropped below the acceptable target level at reference numeral 402. Once this Level 1 correction threshold is reached, a first corrective procedure may be initiated. In this example, the corrective action is appending of a paperless print sheet to be run at cycle-out at the end of the active print job queue.

At this threshold below Level 1, corrective action is not required immediately so that a customer job does not have to be interrupted. Instead, when the second job or series of jobs in the print queue is complete (cycle-out) as indicated by reference numeral 403, a corrective low area coverage maintenance pattern is provided during a pitch of the machine added at the end of the cycle and the toner from the pattern is transported to the cleaner station F without activation of the transfer station D or advancement of a paper sheet. The paperless pattern is not transferred to a sheet of paper or other medium so that the toner of the paperless pattern is still on the surface of the photoconductive member when it arrives at the cleaner blade. Tide pattern may be of any predefined form, such as a uniform grayscale, formed over a majority of the page surface area, at least spanning a majority of the height of the page so as to provide toner dam material across the entire length of cleaning brush 76. This results in a large amount of residual toner remaining oil the photoconductive surface 12 for replenishing the toner dam 100.

As shown at the second cycle-out, indicated by reference numeral 403, this corrective action restores the toner dam mass to within the target range. This level is slightly increased at the third cycle-in. If, however, the second or subsequent print job is a long job and the toner dam mass drops below a second threshold Level 2, a more corrective procedure may be introduced. In this example, the second level corrective procedure may also be performed at the completion of a customer job to avoid interruption to the customer job. However, to achieve an increased replenishment rate, the second corrective procedure may use a high area coverage paperless print sheet in an attempt to increase the toner mass to within the target range. An example of this is shown by reference numeral 405 in FIG. 4.

If, however, the print jobs in the queue are particularly long or result in very low toner area coverage it is possible that the toner dam mass may drop to a third threshold level (Level 3) in which more immediate corrective action may be necessary to avoid or reduce damage to the machine or component failure. At this third threshold level, the current print job will be interrupted for insertion of a paperless print sheet, preferably of high surface area coverage, at the earliest opportunity without waiting for the queued jobs to be completed (cycle out). An example of this is shown by reference numeral 404, which occurs mid-job without waiting for cycle out. Although this may be a minor inconvenience to the user, it will maintain proper operation of the machine, which in the long run will improve customer satisfaction.

As shown, this results in a new estimate of the toner dam mass. Hopefully, this action returns the toner darn mass to within the desired target range. However, if as shown at reference numeral 404 the third level corrective action is insufficient to fully restore the toner mass to the target range, another paperless sheet may be inserted, or the system may continue to operate with the toner mass being at a Level 1 or Level 2 stage, in which another corrective procedure may occur at the end of the next cycle out as shown at reference numeral 405.

In this illustrative example, three maintenance levels are provided, and two maintenance patterns are available: a low area coverage maintenance pattern and a high area coverage maintenance pattern. Although the system and methods are not limited to this, a test copier running with this blade maintenance strategy ran over three million copies without a cleaning failure. Thus, wear and maintenance have been found to be dramatically reduced by following this strategy of modeled toner replenishment. Moreover, as the corrective procedure takes place primarily upon completion of a customer print job, the corrective action is achieved without inconvenience to the user, such as delay or interruption of a job.

Referring back to FIG. 1, because the customer images are transferred prior to cleaning, the amount of untransferred toner remaining on surface 2 being cleaned by blade 76 at cleaning station F is small, particularly with EA toner, which can have a transfer efficiency as high as 98%, compared with conventional toner, which has a typical transfer efficiency of 90%. Accordingly, the toner dam level can decrease after printing, particularly for low area coverage images, because the leakage rate from the cleaner blade is typically higher than the residual from these print jobs. However, because corrective actions according to the blade maintenance strategy include insertion of a paperless print sheet during a pitch added at cycle out, or interrupt the customer job and insert a paperless print sheet during a skipped pitch in the middle of the print queue between cycle in and cycle out, and these paperless sheets are not transferred, a higher degree of toner remains on the photoconductive surface. This replenishes the toner mass expeditiously. Thus, a rapid recovery of the toner mass to within the target range can be achieved usually in an unobtrusive manner.

Figure 5:
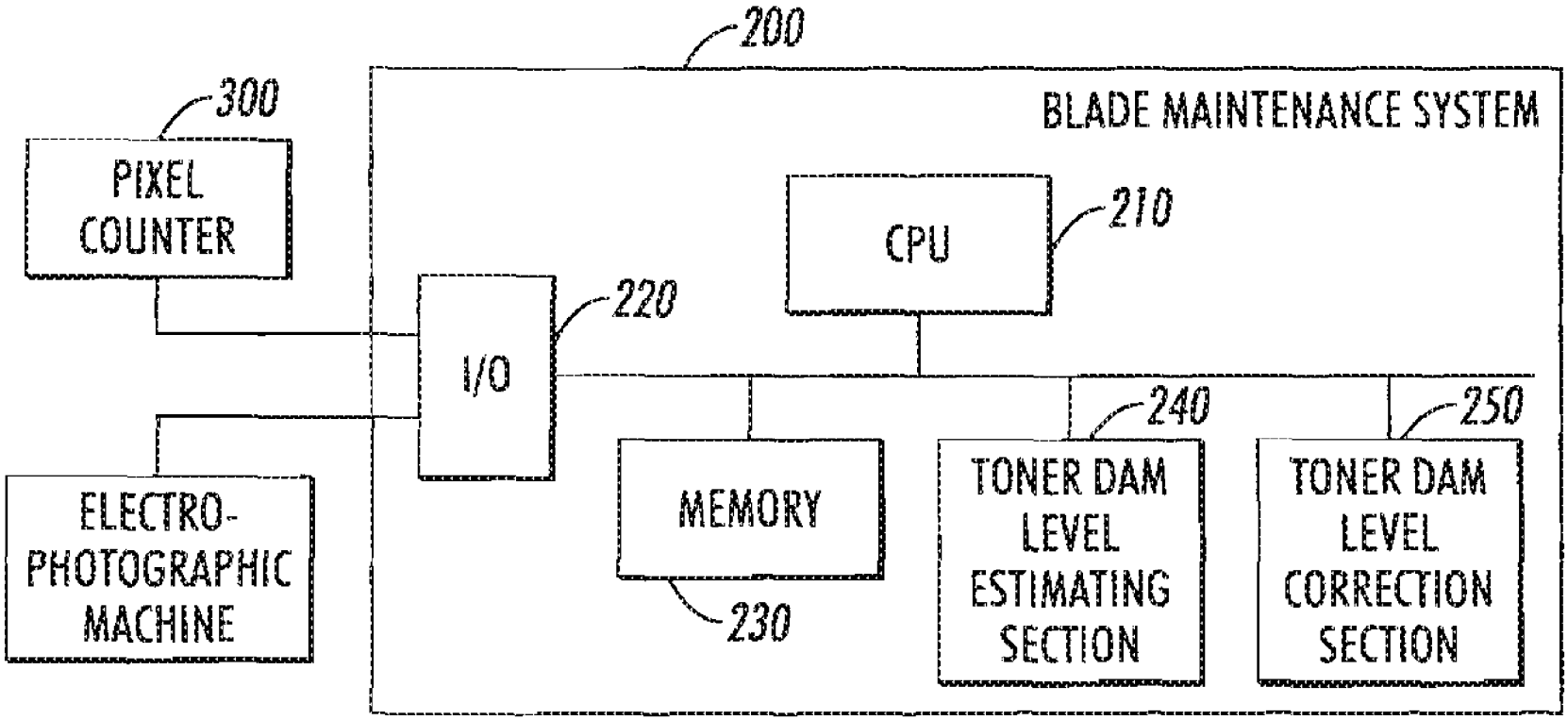
FIG. 5 is a block diagram of an exemplary blade maintenance system.

FIG. 5 illustrates an exemplary block diagram of a blade maintenance system 200, which includes a CPU 210, input/output section 2200 for receiving input values pertinent to toner dam calculation, memory 230 for storing inputted variable and various constants or computed values, a toner dam level estimating section 240, and a toner dam level correcting section 250 that determines what, if any, corrective action to take and outputs an instruction to the electrophotographic printing machine to cause a corrective action to be performed by the machine to replenish the toner dam level. Inputs to section 230 may include values stored in memory 220, such as constants and formulas/equations discussed below, and external machine inputs, such as pixel counter 300 which stores a pixel count of the images being printed during each print job.

The corrective blade maintenance strategy graphed in FIG. 4 performed by system 200 of FIG. 5 calculates the toner dam mass level (toner dam balance) using the following exemplary variables and modeling values.

When cycled in:

$$M_R = M_{R(0)} - aT_{PR} + bN_{PIX}$$

At cycle out:

$$M_{R(0)} = M_R$$

At cycle in:

$$M_R = M_{R(0)} + M_{CI/CO}$$

When a maintenance image is inserted:

$$M_R = M_R + cN_{PIX(M1)},$$

Where:

$M_R$ is the maintenance level (in mg) and constrained not to be negative, or greater than some maximum limit ($M_{R,\ max}$)

$M_{R(0)}$ is the maintenance level at cycle out (mg), $M_{CI/CO}$ is the mass of toner developed within the cycle out and in bands (mg), $T_{PR}$ is the time since cycle in (seconds), $N_{PIX}$ is the cumulative pixel count since cycle in (units of $10^5$ pixels), $N_{PIX(M)L}$ is the number of pixels in the low-AC maintenance image (units of $10^5$ pixels), $N_{PIX(M)H}$ is the number of pixels in the high-AC maintenance image (units of $10^5$ pixels), $N_{PIX(M1)}$ is the number of pixels in the maintenance image (units of $10^5$ pixels) and is one of $N_{PIX(M)L}$ or $N_{PIX(M)H}$, a is a coefficient (mg per second), b is a coefficient (mg per $10^5$ pixels), and c is a coefficient (mg per $10^5$ pixels).

In an exemplary embodiment, the following coefficients and values were used. However, these may vary depending on the machine and other variables.

Coefficient a 350 mg/ms (machine speed dependent)
Coefficient b 16 μg/$10^5$ pixels
Coefficient c 805 μg/$10^5$ pixels
$M_{CI/CO}$ 10 mg (machine speed dependent)
Level 1 32 mg
Level 2/3 12 mg
Target Level 42 mg
$M_{R,\,max}$ 42 mg Note that setting coefficients a, b, and c to zero will disable the feature. Also, to apply just sufficient toner to reinstate the target amount at the cleaner blade without wastage, the level 1 threshold in certain embodiments is approximately equal to $cN_{PIX(M1)}-M_{CI/CO}$ for the low area coverage image. Moreover, if Level 1 is significantly greater than $cN_{PIX(M1)}-M_{CI/CO}$ it will never be possible to reinstate the desired toner mass at the cleaner blade. In certain embodiments, the Level 2 threshold is approximately equal to $cN_{PIX(M1)}-M_{CI/CO}$ for the high area coverage image. In certain embodiments, the Level 3 threshold is set as the difference between a desired toner mass level at the blade and the absolute minimum acceptable mass of the toner at the blade, with a contingency for a predetermined sheet delay in corrective action, such as a 30 sheet delay.

It is believed that the foregoing description is sufficient for purposes of the present application to illustrate the general operation of an electrophotographic printing machine. Moreover, while the present invention is described in an embodiment of a single color printing system, there is no intent to limit it to such an embodiment. On the contrary, the present invention is intended for use in multi-color printing systems as well, or any other printing system having a cleaner blade and toner.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the followings claims.

What is claimed is:

1. A toner dam maintenance system for maintaining a toner dam at a cleaner blade in an electrophotographic machine that cleans a photoconductive surface for receiving toner images thereon, wherein the toner images on the photoconductive surface pass across the cleaner blade, the cleaner blade cleaning toner from the surface thereof while leaving a toner dam on an upstream side of the cleaner blade, the system comprising: a controller including a toner level estimating section that models a toner dam balance of the cleaner blade over time based on received toner input sources including untransferred toner from the print jobs, cycle-in/cycle-out bands of the electrophotographic machine, and untransferred background minus estimated toner leakage from the cleaner blade; and a toner level correction section that provides at least one corrective action to the electrophotographic machine to replenish the toner dam towards a target level range when the toner dam balance is below a threshold level, wherein the corrective action includes inserting a corrective maintenance pattern on the photoconductive surface without transfer of the toner, and wherein modeling values include the following:

when cycled in:

$$M_R=M_{R(0)}+aT_{PR}-bN_{PIX}$$

at cycle out:

$$M_{R(0)}=M_R$$

at cycle in:

$$M_R=M_{R(0)}-M_{CI/CO}$$

when a maintenance image is inserted:

$$M_R=M_R+cN_{PIX(M1)},$$

where:

$M_R$ is the maintenance level (in mg) and constrained not to be negative,
$M_{R(0)}$ is the maintenance level at cycle out (mg),
$M_{CI/CO}$ is the mass of toner developed within the cycle out and in bands (mg),
$T_{PR}$ is the time since cycle in (seconds),
$N_{PIX}$ is the cumulative pixel count since cycle in (units of $10^5$ pixels),
$N_{PIX(M)L}$ is the number of pixels in a low area coverage maintenance image (units of $10^5$ pixels),
$N_{PIX(M)H}$ is the number of pixels in a high area coverage maintenance image (units of $10^5$ pixels),
$N_{PIX(M1)}$ is the number of pixels in the maintenance image (units of $10^5$ pixels) and is one of $N_{PIX(M)L}$ or $N_{PIX(M)H}$,
a is a coefficient (mg per second),
b is a coefficient (mg per $10^5$ pixels), and
c is a coefficient (mg per $10^5$ pixels).

2. The toner dam maintenance system for an electrophotographic machine according to claim 1, wherein the corrective maintenance pattern is a low area coverage pattern.

3. The toner dam maintenance system for an electrophotographic machine according to claim 1, wherein the corrective maintenance pattern is a high area coverage pattern.

4. The toner dam maintenance system for an electrophotographic machine according to claim 1, wherein the toner level correction section has multiple threshold levels, each of which may include a different corrective action.

5. The toner dam maintenance system for an electrophotographic machine according to claim 4, wherein the corrective action includes inserting a corrective maintenance pattern on the photoconductive surface without transfer of the toner.

6. The toner dam maintenance system for an electrophotographic machine according to claim 5, wherein the corrective maintenance pattern is a low area coverage pattern.

7. The toner dam maintenance system for an electrophotographic machine according to claim 5, wherein the corrective maintenance pattern is a high area coverage pattern.

8. The toner dam maintenance system for an electrophotographic machine according to claim 5, wherein a first corrective action for a first threshold level is performed only at cycle out after printing current jobs.

9. The toner dam maintenance system for an electrophotographic machine according to claim 8, wherein a second corrective action for a second threshold level of more severity is performed prior to cycle out and includes interrupting the printing of a print job and inserting a corrective maintenance pattern during a skipped pitch of the photoconductive surface on the photoconductive surface without transfer of the toner.

10. A toner dam maintenance method for maintaining a toner dam at a cleaner blade in an electrophotographic machine that cleans a photoconductive surface for receiving toner images thereon, comprising:

operating the electrophotographic machine to pass the photoconductive surface on which toner is applied across the cleaner blade to form a toner dam upstream of the cleaner blade;

modeling a toner dam balance of the cleaner blade over time based on received toner input sources including untransferred toner from print jobs, cycle-in/cycle-out bands of the electrophotographic machine, and untransferred background minus estimated toner leakage from the cleaner blade; and performing at least one corrective action to the electrophotographic machine to replenish the toner dam towards a target level range when the toner dam balance is below at least one threshold level, wherein the corrective action includes inserting a corrective maintenance pattern on the photoconductive surface without transfer of the toner, and wherein modeling values include the following:

when cycled in:

$$M_R=M_{R(0)}+aT_{PR}-bN_{PIX}$$

at cycle out:

$$M_{R(0)}=M_R$$

at cycle in:

$$M_R=M_{R(0)}-M_{CI/CO}$$

when a maintenance image is inserted:

$$M_R=M_R+cN_{PIX(M1)},$$

where:

$M_R$ is the maintenance level (in mg) and constrained not to be negative, $M_{R(0)}$ is the maintenance level at cycle out (mg), $M_{CI/CO}$ is the mass of toner developed within the cycle out and in bands (mg), $T_{PR}$ is the time since cycle in (seconds), $N_{PIX}$ is the cumulative pixel count since cycle in (units of $10^5$ pixels), $N_{PIX(M)L}$ is the number of pixels in a low area coverage maintenance image (units of $10^5$ pixels), $N_{PIX(M)H}$ is the number of pixels in a high area coverage maintenance image (units of $10^5$ pixels), $N_{PIX(M1)}$ is the number of pixels in the maintenance image (units of $10^5$ pixels) and is one of $N_{PIX(M)L}$ or $N_{PIX(M)H}$, a is a coefficient (mg per second), b is a coefficient (mg per $10^5$ pixels), and c is a coefficient (mg per $10^5$ pixels).

11. The toner dam maintenance method according to claim 10, wherein the corrective maintenance pattern is a low area coverage pattern.

12. The toner dam maintenance method according to claim 10, wherein the corrective maintenance pattern is a high area coverage pattern.

13. The toner dam maintenance method according to claim 10, wherein multiple threshold levels are provided, each of which may include a different corrective action.

14. The toner dam maintenance method according to claim 13, wherein a first corrective action for a first threshold level is performed at cycle out at the end of a current print job.

15. The toner dam maintenance method according to claim 14, wherein a second corrective action for a second threshold level of more severity includes interrupting the printing of a print job prior to cycle out and inserting a corrective maintenance pattern on the photoconductive surface during a skipped pitch of the photoconductive surface without transfer of the toner.

16. A toner dam maintenance method for maintaining a toner dam at a cleaner blade in an electrophotographic machine that cleans a photoconductive surface for receiving toner images thereon, comprising:

operating the electrophotographic machine to pass the photoconductive surface on which toner is applied across the cleaner blade to form a toner dam upstream of the cleaner blade;

modeling a toner dam balance of the cleaner blade over time based on received toner input sources including untransferred toner from print jobs, cycle-in/cycle-out bands of the electrophotographic machine, and untransferred background minus estimated toner leakage from the cleaner blade; and performing at least two corrective actions to the electrophotographic machine to replenish the toner dam towards a target level range when the toner dam balance is below at least two threshold levels, wherein a first corrective action includes inserting a corrective maintenance pattern on the photoconductive surface without transfer of the toner after cycle out and a second corrective action includes inserting a corrective maintenance pattern on the photoconductive surface without transfer of the toner prior to cycle out, wherein modeling values include the following:

when cycled in:

$$M_R=M_{R(0)}-aT_{PR}+bN_{PIX}$$

at cycle out:

$$M_{R(0)}=M_R$$

at cycle in:

$$M_R=M_{R(0)}+M_{CI/CO}$$

when a maintenance image is inserted:

$$M_R=M_R+cN_{PIX(M1)},$$

where:

$M_R$ is the maintenance level (in mg) and constrained not to be negative, or greater than an upper limit $M_{R,\,max}$, $M_{R(0)}$ is the maintenance level at cycle out (mg), $M_{CI/CO}$ is the mass of toner developed within the cycle out and in bands (mg), $T_{PR}$ is the time since cycle in (seconds), $N_{PIX}$ is the cumulative pixel count since cycle in (units of $10^5$ pixels), $N_{PIX(M)L}$ is the number of pixels in a low area coverage maintenance pattern (units of $10^5$ pixels), $N_{PIX(M)H}$ is the number of pixels in a high area coverage maintenance pattern (units of $10^5$ pixels), $N_{PIX(M1)}$ is the number of pixels in the maintenance image (units of $10^5$ pixels) and is one of $N_{PIX(M)L}$ or $N_{PIX(M)H}$, a is a coefficient (mg per second), b is a coefficient (mg per $10^5$ pixels), and c is a coefficient (mg per $10^5$ pixels).

17. The toner dam maintenance method according to claim 16, wherein the corrective maintenance pattern includes insertion of one of a low area coverage pattern and a high area coverage pattern on the photoconductive surface without transfer of the toner at a point in time based on the threshold level reached.

* * * * *